United States Patent [19]

Lott et al.

[11] Patent Number: 4,518,519

[45] Date of Patent: May 21, 1985

[54] ACID BASED VARIABLE VISCOSITY COMPOSITIONS SUCH AS CORROSION AND GREASE REMOVERS AND POLISHES

[76] Inventors: Peter F. Lott, 5414 Holmes St., Kansas City, Mo. 64110; Reiner E. Jargosch, 5401 Brookside Blvd., #203, Kansas City, Mo. 64112

[21] Appl. No.: 516,663

[22] Filed: Jul. 22, 1983

Related U.S. Application Data

[63] Continuation of Ser. No. 289,188, Aug. 3, 1981, abandoned, which is a continuation-in-part of Ser. No. 254,896, Apr. 16, 1981, abandoned, which is a continuation-in-part of Ser. No. 233,945, Feb. 12, 1981, abandoned.

[51] Int. Cl.[3] ..... C11D 7/08; C11D 7/34

[52] U.S. Cl. ..... 252/148; 134/40; 134/41; 252/86; 252/87; 252/143; 252/146; 252/149; 252/150; 252/174.23; 252/391; 252/392; 252/394; 252/396; 422/7

[58] Field of Search ..... 134/3, 40, 41; 252/81, 252/82, 86, 142, 143, 144, 145, 148, 149, 150, 151, 146, 155, 387, 542, 394, 391, 392, 396; 422/7

[56] References Cited

U.S. PATENT DOCUMENTS

| | | | |
|---|---|---|---|
| 2,496,596 | 2/1950 | Moyer et al. | 252/8.55 |
| 2,524,825 | 10/1950 | Pabst et al. | 252/142 |
| 2,737,491 | 3/1956 | Hughes et al. | 252/8.55 |
| 2,814,593 | 11/1957 | Beiswanger et al. | 252/8.55 |
| 3,113,113 | 12/1963 | Marsh et al. | 252/392 |
| 3,249,548 | 5/1966 | Herman et al. | 252/136 |
| 3,709,823 | 1/1973 | Sugahara et al. | 252/136 |
| 3,962,110 | 6/1976 | Tate | 252/181 |
| 4,079,011 | 3/1978 | Tate | 252/8.55 C |
| 4,212,759 | 7/1980 | Young et al. | 252/119 |
| 4,216,032 | 8/1980 | Hyner et al. | 148/6.15 Z |
| 4,244,826 | 1/1981 | Swanson | 252/8.55 C |
| 4,247,344 | 1/1981 | Tsuda et al. | 148/6.14 R |

FOREIGN PATENT DOCUMENTS

| | | |
|---|---|---|
| 2209858 | 8/1974 | France . |
| 2094 | 1/1973 | Japan . |
| 15485 | 2/1979 | Japan . |

*Primary Examiner*—Prince E. Willis

*Attorney, Agent, or Firm*—Schmidt, Johnson, Hovey & Williams

[57] ABSTRACT

An improved, highly penetrating rust remover and/or degreaser composition for metallic surfaces is provided which is chemically inhibited to substantially prevent oxidation-reduction reactions with a metal substrate and limit the action of the composition to a chemical attack on corrosion. The composition is preferably a single phase dispersion and includes respective quantities of an acid such as hydrochloric acid and phosphoric acid, an organic compound containing a nitrogen, oxygen or sulfur atom such as N-(2-hydroxyethyl) oxazolidine, an alcohol or other organic solvent for grease removal, water and one or more emulsifiers (e.g., a derivative of hydrogenated tallow) for stabilizing and lowering the surface tension of the resultant composition. The compositions may be formulated as liquids or with a viscosity control agent such as a polymer of vinyl pyrrolidone to give a paste-like consistency permitting easy use thereof on vertical surfaces, In other forms, the compositions hereof may include a mild abrasive such as activated silica gel.

16 Claims, 1 Drawing Figure

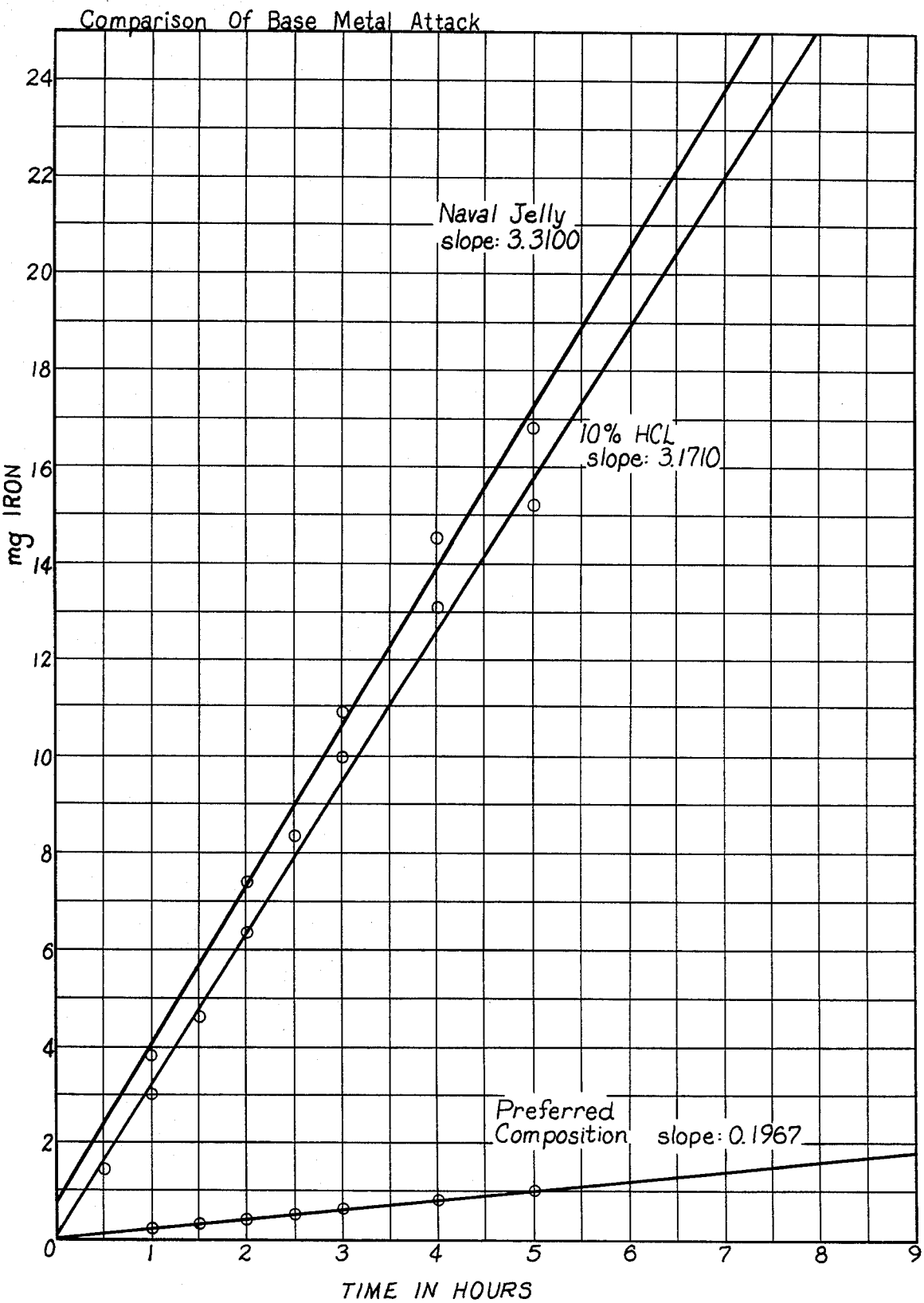
Comparison Of Base Metal Attack
Naval Jelly
slope: 3.3100
10% HCL
slope: 3.1710
Preferred
Composition
slope: 0.1967
mg IRON
TIME IN HOURS
0
2
4
6
8
10
12
14
16
18
20
22
24
1
2
3
4
5
6
7
8
9

ACID BASED VARIABLE VISCOSITY COMPOSITIONS SUCH AS CORROSION AND GREASE REMOVERS AND POLISHES

This application is a continuation of application Ser. No. 289,188, filed Aug. 3, 1981 which was a continuation-in-part of Ser. No. 254,896, filed Apr. 16, 1981 which was in turn a continuation-in-part of Ser. No. 233,945, filed Feb. 12, 1981, all abandoned.

BACKGROUND OF THE INVENTION

1. Field of the Invention

The present invention is concerned with improved, acid-based corrosion, grease removal and polishing compositions for treating metallic surfaces and objects. More particularly, it is concerned with such compositions which are compounded so as to substantially prevent oxidation-reduction reactions that would normally take place at a metallic surface, and allow only acid attack of the oxides on the metal. In preferred forms, the compositions hereof may include polyvinyl pyrrolidone as a viscosity control agent and inhibitor, a derivative of hydrogentated tallow as an emulsifier, and an N-substituted oxazolidine as an acid inhibitor.

2. Description of the Prior Art

Compositions for removing corrosion (metal oxides) from metallic surfaces and objects have long been available. Generally speaking, such materials are acid based, i.e., they rely upon an acidic attack in order to remove corrosion.

A persistent problem encountered in connection with prior corrosion removal compositions and polishes stems from the fact that oxidation-reduction reactions can occur between the compositions and the underlying metal surfaces to be cleaned and decorroded. Hence, while many of these prior compositions were effective in corrosion removal and/or polishing, they often were prone to attack the metal substrate and leave the same pitted and unattractive.

Another problem with such prior compositions stems from the fact that they are ineffective as grease removers. Accordingly, if the metallic surfaces desired to be decorroded had substantial amounts of fatty organic (oil) films thereon, the effectiveness of the compositions was reduced, and the acidic and aqueous components thereof hindered in removal of corrosion.

Furthermore, such solutions were of uncontrolled viscosity, either being too viscous to prevent application by spray or brush, or too low in viscosity to cling on vertical surfaces.

SUMMARY OF THE INVENTION

The present invention overcomes the problems noted above, and provides greatly improved, flowable, aqueous, highly penetrating compositions of acidic pH which are effective for polishing and removal of corrosion from metallic surfaces, and also to degrease the same. The compositions of the present invention may include respective quantities of an acid, an organic compound having a nitrogen, oxygen or sulfur atom therein, an alcohol or other organic solvent, water and at least one emulsifier.

In preferred forms, the acid component is selected from the group consisting of hydrochloric, sulfuric, phosphoric, acetic, citric, nitric, boric and mixtures thereof. The acid is further preferably present at a level of from about 2% to 95% by weight, and more preferably from about 5% to 37% by weight.

The organic compound is advantageously selected from the group consisting of N-substituted oxazolidines (most preferably N-(2-hydroxyethyl)oxazolidine), the p-alkyl benzyl pyridine chlorides, phenylthiourea, 2-mercaptobenzothiazole, di-ortho-tolyl-thiourea, pyridine, quinoline, decylamine, the dibenzyl sulfoxides, 2-butyne-1, 4-diol, 1-hexyne-3-ol, 4-ethyl-1-octyne-3-ol, decylamine, soyaamine, octadecylamine, trimethylsoyaammonium chloride, trimethyloctadecylammonium chloride, trimethyldodecylammonium chloride, trimethyltallowammonium chloride, N-coco-1, 3-diaminopropane, the tetraalkylammonium bromides having an alkyl group with at least 10 carbon atoms therein, the mono-, di-, and tributylamines, hexamethylenediamine, polyvinyl pyrrolidone, 2-(bis)2-hydroxyethyl(amino)-1,3-propanediol, 2-(bis)-2-hydroxyethyl-(amino)-methanediamine, 1,6,8-triaza-4,10-dioxabicyclo[5,5,0]dodecane, and mixtures thereof. Such compounds should be used at a level of from about 0.01% to 20% by weight, and more preferably from about 0.5% to 5% by weight.

The alcohol component is most preferably 1-propanol, but other alcohols could also be employed. As used herein, other alcohols refers to an alcohol having an alkyl group with from about 1 to 10 carbon atoms, inclusive. The alcohol should be used at a level of up to 40% by weight, and most preferably at a level of about 1 to 8% by weight.

The water should be present at a level of from about 30% to 80% by weight, and most advantageously at a level of from about 50% to 80% by weight.

The most preferred emulsifiers for use in the invention are selected from the group consisting of the derivatives of hydrogenated tallow (e.g., N,N',N'-tris(2-hydroxyethyl)-N-tallow-1,3-diaminopropane or amine acetate hydrogenated tallow), polyoxyethylene ethers, polyoxyethylene ester alcohols, polyoxyethylene esters of mixed fatty and resin acids and mixtures thereof, although other specific types referred to hereinafter also have utility. The total amount of emulsifier present in the composition should be from about 0.1% to 15% by weight, and more preferably from about 0.5% to 5% by weight.

A viscosity control agent (thickener) can also be used in the compositions hereof to give variations in viscosity. Such viscosity control has heretofore proved to be difficult or impossible to obtain in acidic compositions, inasmuch as most conventional thickeners tend to flocculate at low pH. The control agents of the invention should be selected from the group consisting of polyvinylpyrrolidine and the allylamine emulsion polymers. The pyrrolidone is preferred, however, inasmuch as it also acts as a corrosion inhibitor on metallic surfaces. The viscosity control agent should be used at a level of up to about 35% by weight, and most preferably at a level of from about 0.5 and 5% by weight.

A synergistic effect is observed by the use of the mixture of polyvinyl pyrrolidone, Ethoduomeen T/13, and N-(2-hydroxyethyl)-oxazolidine as a corrosion inhibitor in preventing base metal attack, inasmuch as the attack with the preferred mixture is less than that of any of the individual corrosion inhibitors.

In further forms of the invention, a mild abrasive such as activated silica gel (at a level of up to about 10% by weight) can be employed. Perfumes and coloring agents can be added as desired. In addition the system can be modified for corrosion removal on metal surfaces having a heavy grease or oil coating by preparing a two-phase emulsified system by the addition of toluene or related organic solvents.

BRIEF DESCRIPTION OF THE DRAWING

The single feature is a graphical represention depicting the extent of base metal attack when using a commercially available corrosion remover, 10% HCl, and the preferred corrosion removing composition of the invention.

DESCRIPTION OF THE PREFERRED EMBODIMENTS

The most preferred rust removal compositions in accordance with the present invention contain commercial hydrochloric acid, commercial phosphoric acid, 1-propanol, N-(2 hydroxyethyl)oxazolidine, water, a thickening agent, and N,N',N'-tris(2-hydroxyethyl)-N-tallow-1, 3-diaminopropane as an emulsifier. The following table sets forth the single most preferred rust removal composition, as well as ranges of use of the above identified components:

TABLE I

| Component | Range | Amounts (% by Weight) Preferred |
|---|---|---|
| Commercial hydrochloric acid (37%) | 2–35% | 27% |
| Commercial phosphoric acid (85%) | 0–10% | 4% |
| N—(2-hydroxyethyl) oxazolidine | 0.01–20% | 1% |
| Ethoduomeen T/13[1] | 0.01–15% | 1% |
| 1-propanol | 0–20% | 5% |
| Polyvinylpyrrolidone[2] | 0–15% | 3% |
| Water | 30–90% | 59% |
| | | 100% |

[1]N,N',N'—tris(2-hydroxyethyl)-N—-tris(2-hydroxyethyl)-N—tallow-1,3-diaminopropane, Sold by Armak Industrial Chemical Division, Chicago, Illinois.
[2]Purchased from Sigma Chemical Co., St. Louis, Missouri, and reported to have a molecular weight of 360,000.

The oxazolidine base metal inhibitor component of Table I is prepared by slowly adding, with mixing, 435.7 grams of formaldehyde to a beaker containing 563.3 grams of diethanolamine. After all formaldehyde is added, the mixture should be stirred for an additional hour.

In other contexts, a base metal inhibitor component can be produced as the reaction product of a lower aldehyde (i.e., containing from about 1–4 carbon atoms) and an alkanolamine (containing one or more alkyl group each having from about 2–8 carbon atoms).

In formulating the preferred composition of Table I, a beaker containing 590 grams of water is provided. Ten grams of the Ethoduomeen T/13 hydrogenated tallow emulsifier, 270 grams hydrochloric acid, 40 grams phosphoric acid, and 50 grams of 1-propanol are all added to the beaker, with continual mixing. The mixture is then heated to 50° C.; and 30 grams polyvinylpyrrolidine is slowly added thereto. Mixing is continued until all of the polymer has dissolved.

The drawing graphically illustrates the inhibition against base metal attack provided with the preferred composition of Table I. Specifically, a commercially available corrosion remover sold under the designation "Naval Jelly" was tested, along with a solution of 10% hydrochloric acid, and the preferred composition hereof. In all cases, testing conditions were identical, and the extent of attack on a base metal substrate was measured. As can be seen, the extent of such attack is very high with the Naval Jelly and hydrochloric acid, but is significantly lower with the preferred inhibitor composition of the invention.

In the case of a cleaner/polish for brass and copper, the most preferred compositions, and the ranges of use of components, are set forth below:

TABLE II

| Component | Range | Amounts (% by Weight) Preferred |
|---|---|---|
| Commercial hydrochloric acid (37%) | 0–37% | 13.5% |
| Commercial phosphoric acid (85%) | 0–85% | 2.0% |
| N—(2-hydroxyethyl) oxazolidine | 0.01–20% | 0.5% |
| Ethoduomeen T/13[1] | 0.01–15% | 0.5% |
| 1-Propanol | 0–20% | 2.5% |
| Polyvinylpyrrolidone[2] | 0–35% | 1.5% |
| Water | 30–90% | 79.5% |
| | | 100.0% |

[1,2]Same as in Table I

In preparative procedures all of the components save the polyvinylpyrrolidone are simply admixed as a single phase dispersion or solution, whereupon the mixture is heated to 50° C. (although such heating is optional) and the polymer is slowly added thereto with mixing to give a thickened, viscous composition.

As noted above, a number of different materials can be employed for the various components. With respect to the emulsifier(s), surfactants available from ICI Americas, Inc., Wilmington, Del., and Armak Chemicals Division, Chicago, Ill., can be employed in lieu of or in addition to the preferred tallow based emulsifiers. An exemplary list of such surfactants is provided in Table III.

TABLE III

| Trade Name | Class & Formula | HLB |
|---|---|---|
| Arlatone 285 | Polyoxyethylene fatty acid ester | 14.4 |
| Arlatone 298 | Polyoxyethylene fatty acid ester | 14.4 |
| Arlatone G | Polyoxyethylene fatty glyceride | 10.8 |
| Arlatone 970 | Polyoxyethylene sorbitan fatty acid ester | 14.3 |
| Atlox 1285 | Polyoxyethylene triglyceride | 14.4 |
| Brij 35 | Polyoxyethylene (23) lauryl ether | 16.9 |
| Brij 58 | Polyoxyethylene (20) cetyl ether | 15.7 |
| Brij 78 | Polyoxyethylene (2) stearyl ether | 15.3 |
| Brij 98 | Polyoxyethylene (20) oleyl ether | 15.3 |
| Brij 99 | Polyoxyethylene oleyl ether | 15.3 |
| Atlas G-263 | N—cetyl-N—ethyl morpholinium ethosulfate | 30.0 |
| Atlas G-271 | N—soya-N—ethyl morpholinium ethosulfate | 30.0 |
| Atlas G-1285 | Polyoxyethylene triglyceride | 14.4 |
| Atlas G-1288 | Polyoxyethylene triglyceride | 16.0 |
| Atlas G-1300 | Polyoxyethylene triglyceride | 18.1 |
| Atlas G-1304 | Polyoxyethylene triglyceride | 18.7 |
| Atlas G-1795 | Polyoxyethylene lanolin derivative | 17.0 |
| Atlas G-2079 | Polyoxyethylene palmitate | 15.5 |

TABLE III-continued

| Trade Name | Class & Formula | HLB |
|---|---|---|
| Atlas G-2109 | Polyoxyethylene coconut fatty acid | 13.3 |
| Atlas G-2162 | Polyoxyethylene propylene glycol stearate | 16.0 |
| Atlas G-3634A | Quaternary ammonium derivative | 18.5 |
| Atlas G-3707 | Polyoxyethylene-lauryl-ether | 12.8 |
| Atlas G-3816 | Polyoxyethylene-cetyl-ether | 14.9 |
| Atlas G-3820 | Polyoxyethylene-cetyl-ether | 15.7 |
| Atlas G-4905 | Polyoxyethylene-sorbitan-monoleate | 15.0 |
| Atlas G-4932 | Polyoxyethylene-lauryl-ether | 16.0 |
| Atlas G-4938 | Polyoxyethylene-stearyl-ether | 15.3 |
| Atlas G-4961 | Polyoxyethylene-alky-amine | 15.5 |
| Atlas G-8916P | Polyoxyethylene-sorbitan-ester | 14.6 |
| Myrj 49 | Polyoxyethylene stearate | 15.0 |
| Myrj 51 | Polyoxyethylene stearate | 16.0 |
| Myrj 52 | Polyoxyethylene stearate | 16.9 |
| Myrj 52C | Polyoxyethylene stearate | 16.9 |
| Myrj 52S | Polyoxyethylene stearate | 16.9 |
| Myrj 53 | Polyoxyethylene stearate | 17.9 |
| Myrj 59 | Polyoxyethylene stearate | 18.8 |
| Renex 20 | Polyoxyethylene ester of mixed fatty and resin acids | 13.5 |
| Renex 30 | Polyoxyethylene ether alcohol | 14.5 |
| Renex 649 | Polyoxyethylene alkylaryl-ether | 16.0 |
| Renex 650 | Polyoxyethylene alkylaryl-ether | 17.1 |
| Renex 678 | Polyoxyethylene alkylaryl-ether | 15.0 |
| Renex 679 | Polyoxyethylene alkylaryl-ether | 14.4 |
| Renex 682 | Polyoxyethylene alkylaryl-ether | 13.9 |
| Renex 690 | Polyoxyethylene alkylaryl-ether | 13.3 |
| Renex 698 | Polyoxyethylene alkylaryl-ether | 13.0 |
| Renex 707 | Polyoxyethylene fatty acid alcohol | 12.2 |
| Renex 709 | Polyoxyethylene fatty acid alcohol | 12.5 |
| Renex 711 | Polyoxyethylene fatty acid alcohol | 13.9 |
| Renex 714 | Polyoxyethylene fatty acid alcohol | 14.9 |
| Renex 720 | Polyoxyethylene fatty acid alcohol | 16.2 |
| Tween 20 | Polyoxyethylene-sorbitan monolaurate | 16.7 |
| Tween 20 SD | Polyoxyethylene-sorbitan monolaurate | 16.7 |
| Tween 40 | Polyoxyethylene-sorbitan-monopalmitate | 15.6 |
| Tween 60 | Polyoxyethylene-sorbitan-monostearate | 14.9 |
| Tween 60 SD | Polyoxyethylene-sorbitan-monostearate | 14.9 |
| Tween 80 | Polyoxyethylene-sorbitan-monooleate | 15.0 |
| Tween 80 SD | Polyoxyethylene-sorbitan-monooleate | 15.0 |
| Atlas G 3300 | Alkyl aryl sulfonate | 11.7 |

The compositions of the invention are effective to remove corrosion from base metallic surfaces while substantially preventing oxidation-reduction reactions with the metal itself. In addition, grease removal is enhanced by virtue of the presence of a single phase, aqueous system. Use of the preferred single phase system also enhances the penetration of corrosion where the latter is present.

Representative metals which can be cleaned and/or degreased using the compositions hereon include iron and steel, bronze, brass, copper, monel, nickel, chromium plated metals and aluminum.

A cleaner for tubes of boilers may also be provided by incorporating in the formulation a high foaming agent plus thickeners such as polyvinylpyrrolidone to improve wall adherence. This allows the corrosion remover to be circulated and foamed in place throughout the system by pumping or by an air blast. An additive such as Arlatone G may also be included as desired to help prevent surface rerusting. This type of corrosion remover is advantageous in that a small amount will cover a large surface area and does not require heating to permit the corrosion removal action to take place. Also, since all components are water soluble, removal of the corrosion remover can be performed by flushing water through the system.

An exemplary formulation of a composition containing at least one foaming agent and a thickener is as follows:

TABLE IV

| Components | Permissible Range | Preferred Composition (% by Weight) |
|---|---|---|
| Water | 30-3-0-90% | 69.5% |
| Commercial hydrochloric acid (37%) | 2-37% | 27.0% |
| N—(2-hydroxyethyl) oxazolidine | 0.01-20% | 1.0% |
| Ethoduomeen T/13[1] | 0.01-15% | 1.0% |
| Polyvinylpyrrolidone[2] | 0.1-15% | 1.0% |
| Arlatone G[3] | 0.1-2% | 0.5% |
| | | 100.0% |

[1,2]Same as in Table I.
[3]See Table III.

The preferred boiler tube cleaner is prepared in the same manner as the rust remover and cleaner/polisher described above. The Arlatone G component is added initially with the HCl, oxazolidine and Ethoduomeen.

An additional use and formulation for the removal of carbonate deposits and scales or the application of salts to non-metallic surfaces can be made by using the above formulations with the deletion of the base metal corrosion inhibitor. This formulation enhances surface deposit removal without penetration to the base.

An exemplary formulation of a composition containing at least one degreasing agent and a thickener is as follows:

TABLE V

| Components | Permissible Range | Preferred Composition (% by Weight) |
|---|---|---|
| Water | 25-95% | 77.0% |
| Commercial hydrochloric acid (37%) | 2-37% | 15.0% |
| Rennex 30 | 0-10% | 1.0% |
| Polyvinyl pyrrolidone | 1-35% | 5.0% |
| Ammonium chloride | 0-40% | 2.0% |
| | | 100.0% |

Other acids such as sulfuric, nitric, phosphoric, acetic, citric, boric, or mixtures thereof can be substituted as well as other salts such as sodium perborate, tri-sodium phosphate, ammonium acetate, sodium chloride, etc.

We claim:

1. A metal cleaning composition comprising a flowable, single phase system of water, from about 5 to 37% by weight of an acid selected from the group consisting of hydrochloric, sulfuric, phosphoric, nitric and mixtures thereof, and from about 0.5 to 5% by weight of polyvinylpyrrolidone, said flowable composition being characterized by the properties of penetrating and removing corrosion from metallic surfaces while inhibiting base metal attack against such metallic surfaces.

2. The composition as set forth in claim 1, said composition further including at least one emulsifier.

3. The composition as set forth in claim 2, said emulsifier being present at a level of from about 0.01 to 15% by weight.

4. The composition as set forth in claim 3, said level being from about 0.5 to 5% by weight.

5. The composition as set forth in claim 2, said emulsifier being N,N',N'-tris-(2-hydroxyethyl)-N-tallow-1,3-diaminopropane.

6. The composition as set forth in claim 1, including a compound selected from the group consisting of N-substituted oxazolidines, the p-alkyl benzyl pyridine chlorides, phenylthiourea, 2-mercaptobenzothiazole, di-ortho-tolyl-thiourea, pyridine, quinoline, decylamine, the dibenzyl sulfoxides, 2-butyne-1,4-diol, 1-hexyne-3-ol, 4-ethyl-1-octyne-3-ol, decylamine, soyaamine, octadecylamine, trimethylsoyaammonium choride, trimethyloctadecylammonium chloride, trimethyldodecylammonium chloride, trimethyltallowammonium chloride, N-coco-1, 3-diaminopropane, the tetraalkylammonium bromides having an alkyl group with at least 10 carbon atoms therein, the mono-, di-, and tributylamines, hexamethylenediamine, polyvinylpyrrolidone, 2-(bis)2-hydroxyethyl(amino)-1,3-propanediol, 2-(bis)2-hydroxyethyl(amino)-methanediamine, 1,6,8-triaza-4,10-dioxabicyclo[5,5,0]dodecane, and mixtures thereof.

7. The composition as set forth in claim 6, said compound being N-(2-hydroxyethyl)oxazolidine.

8. The composition as set forth in claim 6, said compound being present at a level of from about 0.01 to 20% by weight.

9. The composition as set forth in claim 8, said level being from about 0.5 to 5.0% by weight.

10. The composition as set forth in claim 1, including an alcohol having an alkyl group containing from about 1 to 10 carbon atoms.

11. The composition as set forth in claim 10, said alcohol being 1-propanol.

12. The composition as set forth in claim 10, said alcohol being present at a level of up to about 20% by weight.

13. The composition as set forth in claim 12, said level being from about 1 to 8% by weight.

14. The composition as set forth in claim 1, said composition having water present at a level of from about 30 to 90% by weight.

15. The composition as set forth in claim 14, said level being from about 50 to 80% by weight.

16. A metal cleaning composition comprising a flowable, single phase system of water, about 2–35% by weight hydrochloric acid, and up to about 10% by weight phosphoric acid, and respective minor amounts of N-(2-hydroxyethyl)oxazolodine and N,N',N'-tris-(2-hydroxyethyl)-N-tallow-1,3-diaminopropane and polyvinylpyrrolidone, said flowable composition being characterized by the properties of penetrating and removing corrosion from metallic surfaces while inhibiting base metal attack against such metallic surfaces.

* * * * *